US005788101A

United States Patent [19]

King

[11] Patent Number: 5,788,101

[45] Date of Patent: Aug. 4, 1998

[54] CONTAINER AND CLOSURE

[75] Inventor: Roger Milner King, Bucks, England

[73] Assignee: Beeson and Sons, Limited, Herts, United Kingdom

[21] Appl. No.: 193,610

[22] Filed: Feb. 8, 1994

Related U.S. Application Data

[63] Continuation of Ser. No. 53,179, Apr. 26, 1993, abandoned, which is a continuation of Ser. No. 769,198, Sep. 30, 1991, abandoned.

[30] Foreign Application Priority Data

Jul. 10, 1991 [GB] United Kingdom ..... 9114871

[51] Int. Cl.[6] ..... B65D 41/04; B65D 41/18; B65D 53/04

[52] U.S. Cl. ..... 215/349; 215/317; 215/329; 215/341

[58] Field of Search ..... 215/349, 232, 215/234, 317, 333, 337, 338, 339, 340, 341, 329, 321; 220/254, 256, 258, 304, 356, 357, 306

[56] References Cited

U.S. PATENT DOCUMENTS

| | | | |
|---|---|---|---|
| 198,528 | 12/1877 | Woodward | 215/329 |
| D. 327,644 | 7/1992 | Offley et al. . | |
| D. 329,980 | 10/1992 | Powell et al. . | |
| 1,070,748 | 8/1913 | Stollberg | 215/329 |
| 1,850,911 | 3/1932 | Barlow | 220/258 |
| 2,026,889 | 1/1936 | Gray et al. | 215/337 |
| 2,313,161 | 3/1943 | Merolle | 220/304 X |
| 2,423,582 | 7/1947 | Coleman . | |
| 3,253,728 | 5/1966 | De Putron | 215/329 X |
| 3,741,421 | 6/1973 | Wittwer . | |
| 3,767,076 | 10/1973 | Kennedy | 215/341 X |
| 3,770,153 | 11/1973 | Gach et al. . | |
| 3,826,395 | 7/1974 | Montgomery . | |
| 3,841,514 | 10/1974 | Montgomery et al. . | |
| 3,861,549 | 1/1975 | Watson et al. | 215/232 |
| 3,952,899 | 4/1976 | Cooke . | |
| 3,958,708 | 5/1976 | Le Brun, Jr. . | |
| 4,076,152 | 2/1978 | Mumford . | |
| 4,084,717 | 4/1978 | King . | |
| 4,134,513 | 1/1979 | Mumford . | |
| 4,177,906 | 12/1979 | Von Hagel | 215/252 |
| 4,280,631 | 7/1981 | Lohrman . | |
| 4,328,905 | 5/1982 | Hardt | 220/258 |

(List continued on next page.)

FOREIGN PATENT DOCUMENTS

| | | | |
|---|---|---|---|
| 0 148 527 | 7/1985 | European Pat. Off. . | |
| 36 05 963 | 8/1987 | Germany . | |
| 6707565 | 2/1968 | Netherlands | 215/349 |
| 2 094 274 | 9/1982 | United Kingdom . | |
| 2100236 | 12/1982 | United Kingdom . | |
| 2 142 911 | 1/1985 | United Kingdom . | |
| 2163732 | 3/1986 | United Kingdom . | |

*Primary Examiner*—Allan N. Shoap
*Assistant Examiner*—Niki M. Kopsidas
*Attorney, Agent, or Firm*—Brinks Hofer Gilson & Lione

[57] ABSTRACT

The invention relates to a container neck (10) and closure (12), particularly useful for foil-sealed containers. The neck (10) and closure (12) include complementary threads (14, 16) or projections and complementary tapered surfaces (18, 20) which are adapted to form an interference fit and seal the closure (12) to the neck (10) at a region clear from the lip (30) of the neck (10) and the crown (120) of the closure (12). Any foil seal (28) present on the container neck (10) remains free from contact with the closure (12) during application and tightening. Preferably the neck (10) includes a recessed lip (30, 32) further to protect the seal and to inhibit drop formation. An outer edge of the container lip may be chamfered to provide a pull tab on the foil seal. Additionally, the foil may be of a larger diameter than the lip of the container, so that it provides an overhanging edge of foil to facilitate the removal of the foil, but not of such a large diameter that it touches the inner surface of the closure.

15 Claims, 2 Drawing Sheets

U.S. PATENT DOCUMENTS

| | | | |
|---|---|---|---|
| 4,335,824 | 6/1982 | Bush | 215/224 |
| 4,351,443 | 9/1982 | Uhlig . | |
| 4,371,091 | 2/1983 | Gelina | 220/288 |
| 4,386,712 | 6/1983 | DeWallace . | |
| 4,480,760 | 11/1984 | Schonberger . | |
| 4,562,931 | 1/1986 | Brach et al. . | |
| 4,579,240 | 4/1986 | Ou-Yang . | |
| 4,605,136 | 8/1986 | Debetencourt | 215/232 |
| 4,767,016 | 8/1988 | Cook, Jr. et al. | 215/230 |
| 4,840,281 | 6/1989 | Phillips . | |
| 4,856,674 | 8/1989 | Berney | 220/258 |
| 4,954,191 | 9/1990 | Delespaul et al. | 215/232 X |
| 5,020,683 | 6/1991 | Strassheimer | 215/354 |
| 5,050,754 | 9/1991 | Marino | 215/256 |
| 5,060,813 | 10/1991 | Gollasch et al. | 215/329 |
| 5,213,225 | 5/1993 | King et al. . | |
| 5,219,084 | 6/1993 | King . | |

CONTAINER AND CLOSURE

This application is a continuation of application Ser. No. 08/053,179, filed Apr. 26, 1993, now abandoned, which is a continuation of application Ser. No. 07/769,198, filed Sep. 30, 1991, also abandoned.

This invention relates to a container closure assembly comprising a container neck and a complementary closure. In particular, the invention relates to such an assembly in which the neck is adapted to carry a sealing web, e.g. a foil seal.

Foil sealed containers are used for a variety of different purposes, particular examples being medicine bottles, coffee jars and drinks containers. Commonly, they are used in applications in which the contents of the container are consumed or exhausted over a fixed or well-defined period of time. In such cases, the foil seal provides that the contents of the container remain uncontaminated, or that they retain their original quality, until the foil seal is broken. A secondary seal, between the container and its complementary closure ensures a degree of protection for the contents of the container which is sufficient to preserve the quality of the contents throughout its consumption or usage period.

It has been common practice for the secondary seal to be provided between the lip of the container neck and the crown of the closure, which has the effect of sandwiching the foil seal between the two. Overtightening of the closure can tear or rupture the delicate foil seal.

This invention seeks to overcome this problem, and accordingly provides a container closure assembly comprising a container neck, a container closure and a thread for retaining the closure on the container neck, wherein the inner surface of a skirt portion of the closure is adapted to seal against the outer surface of the container neck.

With the above arrangement, the secondary seal remains entirely clear of the lip of the container neck, and therefore of any foil seal or other sealing web which may be provided thereon.

For additional protection of the sealing web, the assembly may be such that, when the closure is engaged with and sealed to the container neck, a clearance exists between the outer surface of the lip of the container neck and the corresponding inner surface of the closure.

The invention also provides a container closure assembly comprising a container neck, a container closure and means for retaining the closure on the container neck, wherein the inner surface of a skirt portion of the closure is adapted to seal against the outer surface of the container neck and, when the closure is engaged with and sealed to the container neck, a clearance exists between the outer surface of the lip of the neck and the corresponding inner surface of the closure.

This clearance may be afforded by providing the outer surface of the lip with a recess. Preferably, the recess includes a substantially outwardly facing surface which is inclined to the longitudinal axis of the container neck so as to form an overhanging rim on the container. Preferably the inclination of the recess surface is between about 1° and about 45°, preferably about 20°.

Preferably, the container neck includes an outwardly tapered portion and the inner surface of the skirt portion of the closure is adapted to form an interference fit with that tapered portion. This will ensure that no contact, other than accidental contact, occurs between the closure and the lip of the container neck, or any sealing web thereon, during application or tightening of the closure. The skirt portion of the closure can be made large enough to pass over the relatively narrow lip of the container neck and only seal with the neck in a region where the tapered portion is wider.

To provide a good seal, the skirt portion of the closure preferably includes an inwardly tapered surface so as to correspond to the tapered neck. Preferably, the angle of taper is between about 1° and about 45°, most preferably about 1° and about 25°, and in particular about 5°.

In a case where the container neck and closure are of circular section, the means for retaining the closure on the neck preferably includes a thread. Most preferably a thread is provided on the closure and a complementary thread on the container neck.

Alternatively, the skirt portion of the closure may be provided with an inwardly facing deformable projection to engage a complementary outwardly facing projection on the neck. This provides a snap fit closure. Preferably, the projections comprise one or more outstanding beads.

The invention also provides a container neck, adapted to receive a complementary closure and having a sealing web sealed thereto, in which at least a circumferential portion of an outer edge of the lip of the container neck is cut away. This provides that the part of the sealing web which overlies the cut away edge may be used as a pull away tab for the web. Such an arrangement is particularly useful for webs which are adapted to be peeled off.

Preferably the sealing web is at most coextensive with the lip of the container neck. Thus, when the closure is applied, the sealing web is not fouled by the closure.

The cut away edge of the lip may be chamfered, and the container neck, with or without the sealing web may form part of a closure assembly according to the invention.

The invention will now be described by way of example with reference to the accompanying drawing wherein.

Figure 1:
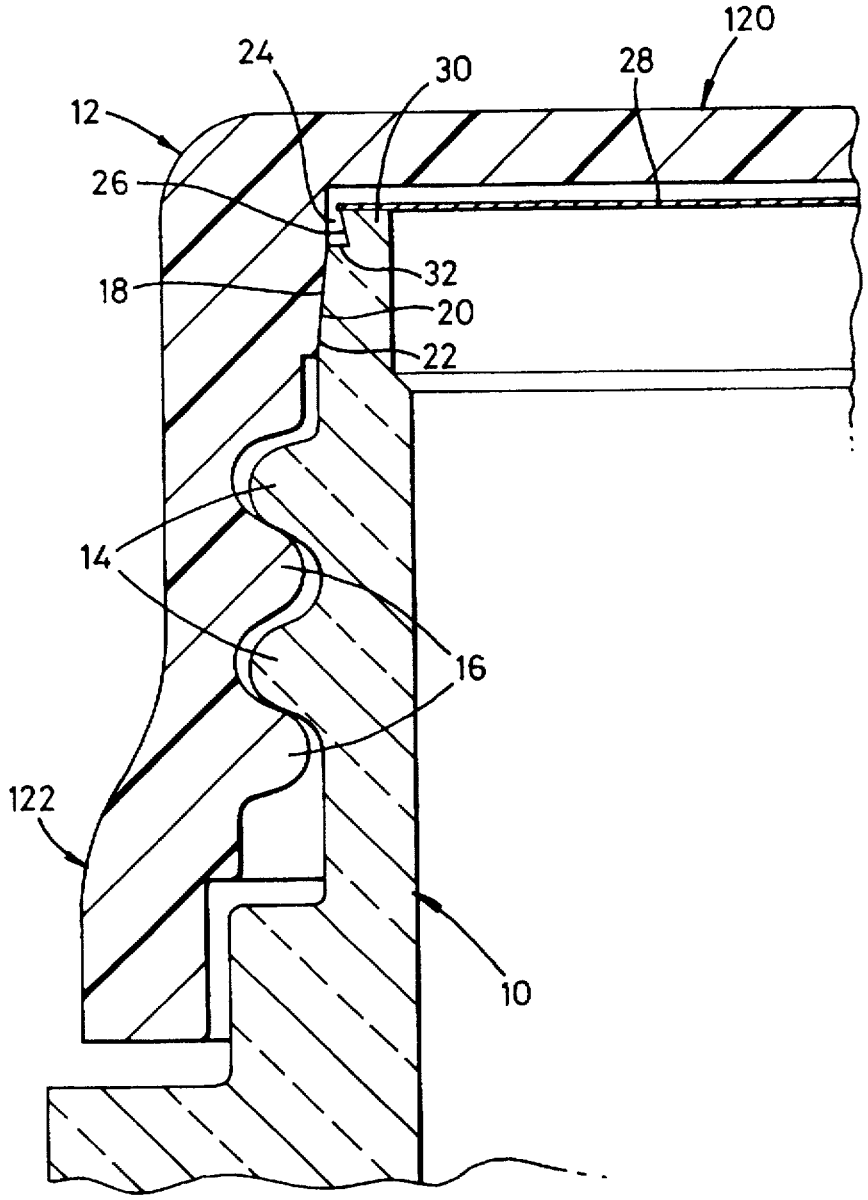
FIG. 1 is a section through a first embodiment of the invention including a threaded closure.

FIG. 1 illustrates a container closure assembly according to the invention including a container neck (10) and a container closure (12). The closure (12) is illustrated in its engaged, sealed position on the container neck (10). In this exemplary embodiment both the neck (10) and the closure (12) are of circular section and are provided with complementary threads (14, 16).

The closure consists of a crown portion (120) and a skirt portion (122). The skirt portion (122) includes an inwardly tapered surface (20) and the container neck (10) includes a corresponding outwardly tapered surface (18). A seal (22) exists between the tapered surfaces (18, 20) by virtue of an interference fit between the two.

The lip (30) of the container neck (10) is sealed by a sealing web (28) which, in this exemplary embodiment is a foil seal. The neck (10) and closure (12) are constructed of materials common in the art, e.g. glass, plastics, metal etc.

As can be seen a clearance (24) exists between the outer surface (26) of the lip (30) and the inner surface of the closure (12). The clearance is of about 1mm and corresponds to a recess (32) in the lip (30). As can be seen, the closure is held away from the edges of the foil seal, to reduce the likelihood of tearing the seal.

Whilst in the embodiment shown in FIG. 1 the clearance (24) is afforded by a recess (32) in the lip (30), it will be appreciated by one skilled in the art that such a clearance may be provided by an appropriate profile on the inner surface of the closure (12), or a combination of profiles on the closure (12) and the neck (10).

The recess (32) includes a substantially outwardly facing surface (26) which tapers inwardly away from the open end of the lip. This forms a drip-free, overhanging rim.

The diameter of the inside surfaces of the closure threads (16) is greater than that of the sealing web or foil (28). The complementary threads (14, 16) may therefore be engaged without any portion of the closure (12) contacting the sealing web (28). Rotation of the closure (12) advances it axially until its tapered surface (20) interferes with that (18) on the neck (10). No stress is applied to the sealing web (28).

The secondary seal (22) between the tapered surfaces (18, 20) has been found in shelf tests to be, for practical purposes, of equal integrity to the foil seal itself. This offers a substantial improvement over the prior art.

A container closure assembly according to this, or any other embodiment of the invention may for example be applied to the container and closure which forms the subject of our international patent application PCT GB91/00850.

Figure 2:
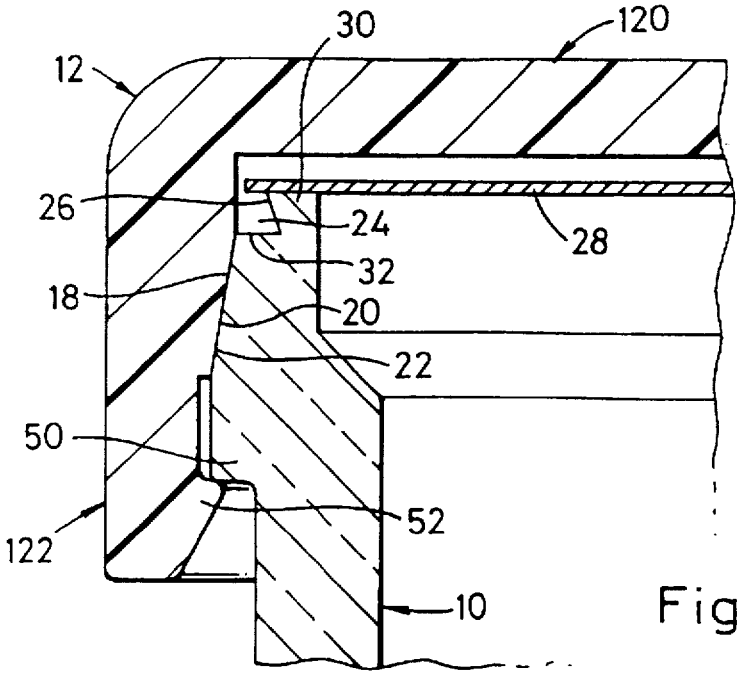
FIG. 2 is a section through a second embodiment, in which the closure snaps onto the container neck.

FIG. 2 illustrates an assembly similar to that shown in FIG. 1, but which includes a snap-fit closure. The closure (12) is, in this embodiment, formed of deformable plastics material. Its skirt portion (122) is provided with an inwardly facing outstanding bead (52) which cooperates with an outstanding projection (50) on the container neck.

Once again, tapered surfaces (18, 20) are provided on the neck and closure to provide an interference seal (22). The outer surface of the container lip (30) is again provided with a recess (32) which is, practically, identical to the recess shown in FIG. 1. The inside diameter of the bead (52) is greater than the diameter of the sealing web (28).

As can be seen, the foil is of a larger diameter than is the recessed container lip so as to provide an overhanging edge of foil to facilitate the removal of the foil. Nevertheless, the foil diameter is not so large that the foil makes contact with the inner surface of the cap.

Figure 3:
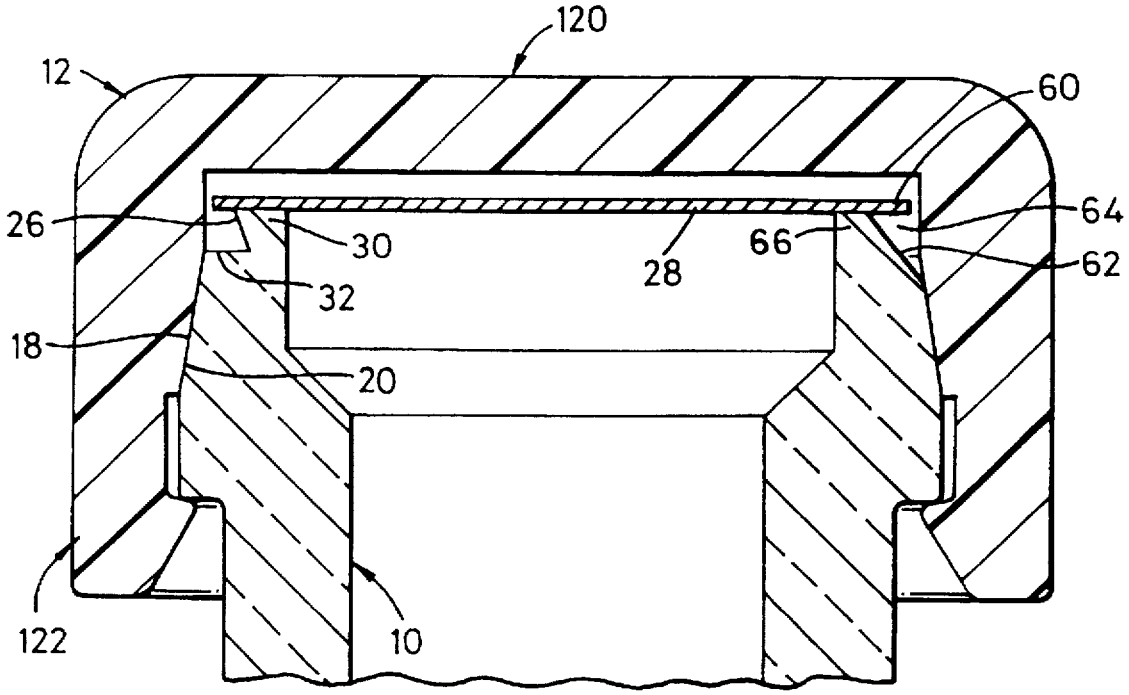
FIG. 3 is a section through the embodiment of FIG. 2, the lip of which has a chamfered edge.

FIG. 3 shows the embodiment of FIG. 2 an edge (66) of the lip (30) of which is chamfered. The chamfer results in an inclined surface (62) which creates a space (64) beneath a peripheral portion (60) of the web (28).

This peripheral portion (60) performs the function of a pull tab on the web (28).and is particularly useful when the web (28) is adapted to be peeled off the container lip (30). Of course, the web (28) is still fully sealed to the horizontal surfaces of the lip (30).

It will of course be appreciated that the invention has been described above purely by way of example and that modifications of detail may be made without departing from its scope.

I claim:

1. A container closure assembly comprising:

a container neck having a radially outer sealing surface and a lip with an outer lip surface, said radially outer sealing surface being arranged below and radially outwardly of said lip, wherein said lip of said container neck is provided with a recess that includes a substantially outwardly facing surface which is tapered inwardly away from an open end of the lip so as to form an overhanging rim;

a container closure having an inner closure surface, said container closure including a skirt portion having a radially inner sealing surface adapted to seal against said radially outer sealing surface of said container neck;

a retainer that retains said container closure on said container neck, said retainer being separate from said radially inner sealing surface of said skirt portion and from said radially outer sealing surface of said container neck; and wherein, when said container closure is engaged with and sealed to said container neck, said container closure is clear of said lip and does not apply pressure thereon; and wherein said container neck is sealed with a removable sealing web sealed to said lip.

2. The assembly according to claim 1 in which said container neck and container closure are of substantially circular section and said retainer comprises a thread.

3. The assembly according to claim 2 comprising a thread on said container neck which is complementary to said thread for retaining said container closure on said container neck and wherein said thread for retaining said container closure on said container neck is provided on said container closure.

4. An assembly according to claim 1 in which the container neck has a longitudinal axis and the inclination of the tapered recess surface is about 20 degrees to the longitudinal axis.

5. An assembly according to claim 1 in which said sealing web comprises a foil seal.

6. An assembly according to claim 1 in which said container neck includes an outwardly tapered portion and said radially inner surface of said skirt portion of said container is adapted to form an interference fit with said tapered portion.

7. An assembly according to claim 6 in which said skirt portion of said container closure includes an inwardly tapered surface so as to correspond to the outwardly tapered portion of said container neck.

8. An assembly according to claim 1 wherein said retainer comprises an inwardly facing deformable projection on said skirt portion of said container closure, said projection being adapted to engage a complementary outwardly facing projection on the container neck.

9. An assembly according to claim 8 in which said inwardly facing deformable projection comprises an outstanding bead.

10. A container closure assembly comprising:

a container neck having a radially outwardly facing sealing surface;

a container closure including a skirt portion having a radially inwardly facing surface adapted to seal against said radially outwardly facing sealing surface of said container neck;

a thread for retaining said container closure on said container neck, said thread being separate from said radially inwardly facing sealing surface of said container closure and from said radially outwardly facing sealing surface of said neck; and wherein said container neck includes a lip with an outer lip surface and said container closure includes an inner closure surface, wherein said lip of said container neck is provided with a recess that includes a substantially outwardly facing surface which is tapered inwardly away from an open end of the lip so as to form an overhanging rim, and wherein, when said container closure is engaged with and sealed to said container neck, a clearance exists between said outer lip surface and said inner closure surface, and wherein said container neck is sealed with a removable sealing web sealed to said lip.

11. An assembly according to claim 10 comprising a thread on said container neck which is complementary to said thread for retaining said container closure on said container neck and wherein said thread for retaining said container closure on said container neck is provided on said container closure.

12. An assembly according to claim 10 in which the container neck has a longitudinal axis and the inclination of the tapered recess surface is about 20 degrees to the longitudinal axis.

13. An assembly according to claim 10 in which said sealing web comprises a foil seal.

14. An assembly according to claim 10 in which said container neck includes an outwardly tapered portion and said radially inner surface of said skirt portion of said container closure is adapted to form an interference fit with said tapered portion.

15. An assembly according to claim 14 in which said skirt portion of said container closure includes an inwardly tapered surface so as to correspond to the tapered neck.

* * * * *